US006002652A

United States Patent [19]

Kobayashi et al.

[11] Patent Number: 6,002,652

[45] Date of Patent: Dec. 14, 1999

[54] POINTER-TYPE ELECTRONIC CLOCK

[75] Inventors: Isamu Kobayashi, Tokyo; Kenji Fujita, Saitama; Kenji Shimoda, Tokyo, all of Japan

[73] Assignee: Citizen Watch Co., Ltd., Tokyo, Japan

[21] Appl. No.: 09/000,174

[22] PCT Filed: May 23, 1997

[86] PCT No.: PCT/JP97/01727

§ 371 Date: Apr. 6, 1998

§ 102(e) Date: Apr. 6, 1998

[87] PCT Pub. No.: WO97/45776

PCT Pub. Date: Dec. 4, 1997

[30] Foreign Application Priority Data

May 24, 1996 [JP] Japan ..... 8-129461

[51] Int. Cl.[6] ..... G04B 9/00; G04B 19/04; G04B 19/24; G04F 5/00

[52] U.S. Cl. ..... 368/66; 368/80; 368/157; 368/187

[58] Field of Search ..... 368/76, 80, 157, 368/160, 185, 187, 66, 202–204

[56] References Cited

U.S. PATENT DOCUMENTS

| | | | |
|---|---|---|---|
| 4,192,134 | 3/1980 | Yoshida | 368/188 |
| 4,445,785 | 5/1984 | Chambon et al. | 368/187 |
| 4,459,031 | 7/1984 | Perucchi | 368/69 |
| 4,470,707 | 9/1984 | Chambon et al. | 368/74 |
| 5,245,591 | 9/1993 | Katou | 368/80 |

FOREIGN PATENT DOCUMENTS

| | | |
|---|---|---|
| 57-88378 | 6/1982 | Japan . |
| 57-211086 | 12/1982 | Japan . |
| 60-147680 | 8/1985 | Japan . |
| 61-194386 | 8/1986 | Japan . |
| 61-33475 | 8/1986 | Japan . |
| 62-44382 | 11/1987 | Japan . |
| 3-7833 | 2/1991 | Japan . |
| 4-45990 | 4/1992 | Japan . |
| 2698800 | 9/1997 | Japan . |

*Primary Examiner*—Vit Miska

*Attorney, Agent, or Firm*—Townsend and Townsend and Crew LLP

[57] ABSTRACT

Heretofore, in an electronic clock in which a hand is moved a plurality of divisional times per minute and the hand takes one step for each one minute during a correction, when a pointer is stopped at a point other than an exact minute due to a battery replacement or the like, a time correction has been troublesome. The present invention solves the problem and provides a pointer-type electronic clock which can easily perform the time correction even if the clock is arranged so that a minute hand may be moved a plurality of times per minute. The pointer-type electronic clock has a minute hand that is moved at a plurality of divisional steps per minute in a time display state. The minute hand is moved at one step per minute in a correction state. The pointer-type electronic clock comprises minute hand position adjusting means for allowing the minute hand to be moved onto any one of each minute scale and to be then stopped when the minute hand is stopped or time is corrected. When a reduction of a source voltage or the like causes an hour/minute hand to be stopped, since the hand is always stopped at an exact minute position, the correction of the hour/minute hand due to the battery replacement or the like can be easily accomplished.

6 Claims, 3 Drawing Sheets

POINTER-TYPE ELECTRONIC CLOCK

TECHNICAL FIELD

The present invention relates to a pointer type electronic clock, and more specifically to a pointer type electronic clock whose minute hand takes a plurality of steps per minute.

BACKGROUND ART

Heretofore, an electronic clock whose minute hand is moved not at one step per minute but at one step at 15-second intervals, at 20-second intervals or the like has been commercialized. For example, in case of a 20-second-interval movement, such an electronic clock performs three step movements per minute so as to thereby gain one minute. A reason for such an arrangement is to know an approximate second even by the minute hand alone and to reduce a rotating angle of the minute hand so as to thereby facilitate a drive control of a step motor or the like.

On the other hand, if a correction of time, a setting of alarm time or the like is performed in the driving system as described above, this is very troublesome. More specifically, when it is desired to move the minute hand by one or two minutes alone, this driving system has a shortcoming in which a switch operation must be often carried out. Therefore, the applicant discloses, in Japanese Patent Application Laid-open No. 57-169690/1982, a system in which one switch operation allows the clock to gain one minute at the time of setting the alarm.

However, in the conventional electronic clock, the step of the minute hand is normally set to, for example, the 20-second-interval movement. Therefore, when a source voltage is reduced and thus the electronic clock is stopped, the minute hand may be stopped between one minute scale and another minute scale. When a battery replacement or the like is performed and then the minute hand is corrected, this causes the clock to gain one minute each. Thus, the minute hand cannot be set to the minute scale, whereby the time correction is very difficult to perform.

DISCLOSURE OF THE INVENTION

The present invention solves the above problem. It is an object of the present invention to provide a pointer type electronic clock which can easily perform a time correction even if the clock is arranged so that a minute hand may be moved a plurality of times per minute.

In order to achieve the above object, according to the present invention, there is provided a pointer type electronic clock in which a minute hand is moved at a plurality of divisional steps per minute in a time display state and the minute hand is moved at one step per minute in a correction state, and the pointer-type electronic clock comprises minute hand position adjusting means for allowing the minute hand to be moved onto any one of each minute scale and to be then stopped when the minute hand is stopped or time is corrected.

Furthermore, according to the present invention, in the pointer-type electronic clock according to claim 1, the minute hand position adjusting means is controlled by means of a voltage detecting circuit for detecting a source voltage.

Furthermore, according to the present invention, in the pointer-type electronic clock according to claim 1, the minute hand position adjusting means is operated when a clock mode is shifted from a normal state to the correction state.

Furthermore, according to the present invention, in the pointer-type electronic clock according to claim 1, the minute hand is moved at n-time divisional steps per minute in the time display state, and the minute hand position adjusting means has an n-ary counter whose count value indicates a position of the minute hand and minute hand driving means for driving the minute hand onto any one of each minute scale in accordance with an output from the n-ary counter.

Furthermore, according to the present invention, in the pointer-type electronic clock, the minute hand is moved at three divisional steps per minute in the time display state, and the minute hand position adjusting means has a ternary counter whose count value indicates the position of the minute hand and minute hand driving means for driving the minute hand onto any one of each minute scale in accordance with the output from the ternary counter.

Furthermore, according to the present invention, in the pointer-type electronic clock, the minute hand driving means comprises fast forward pulse generating means for generating a fast forward pulse for driving the minute hand and an hour/minute hand adjusting circuit for driving the minute hand by means of the fast forward pulse in accordance with the count value of the ternary counter.

Furthermore, according to the present invention, in the pointer-type electronic clock, the minute hand driving means drives the minute hand by a number resulting from a subtraction of the count value of the ternary counter from 3.

In the electronic clock according to the present invention, when a reduction of the source voltage or the like causes an hour/minute hand to be stopped, since the hand is always stopped at an exact minute position, the correction of the hour/minute hand due to a battery replacement or the like can be easily accomplished.

BEST MODE FOR CARRYING OUT THE INVENTION

Embodiments of the present invention will be described below in detail with reference to the accompanying drawings.

Figure 1:
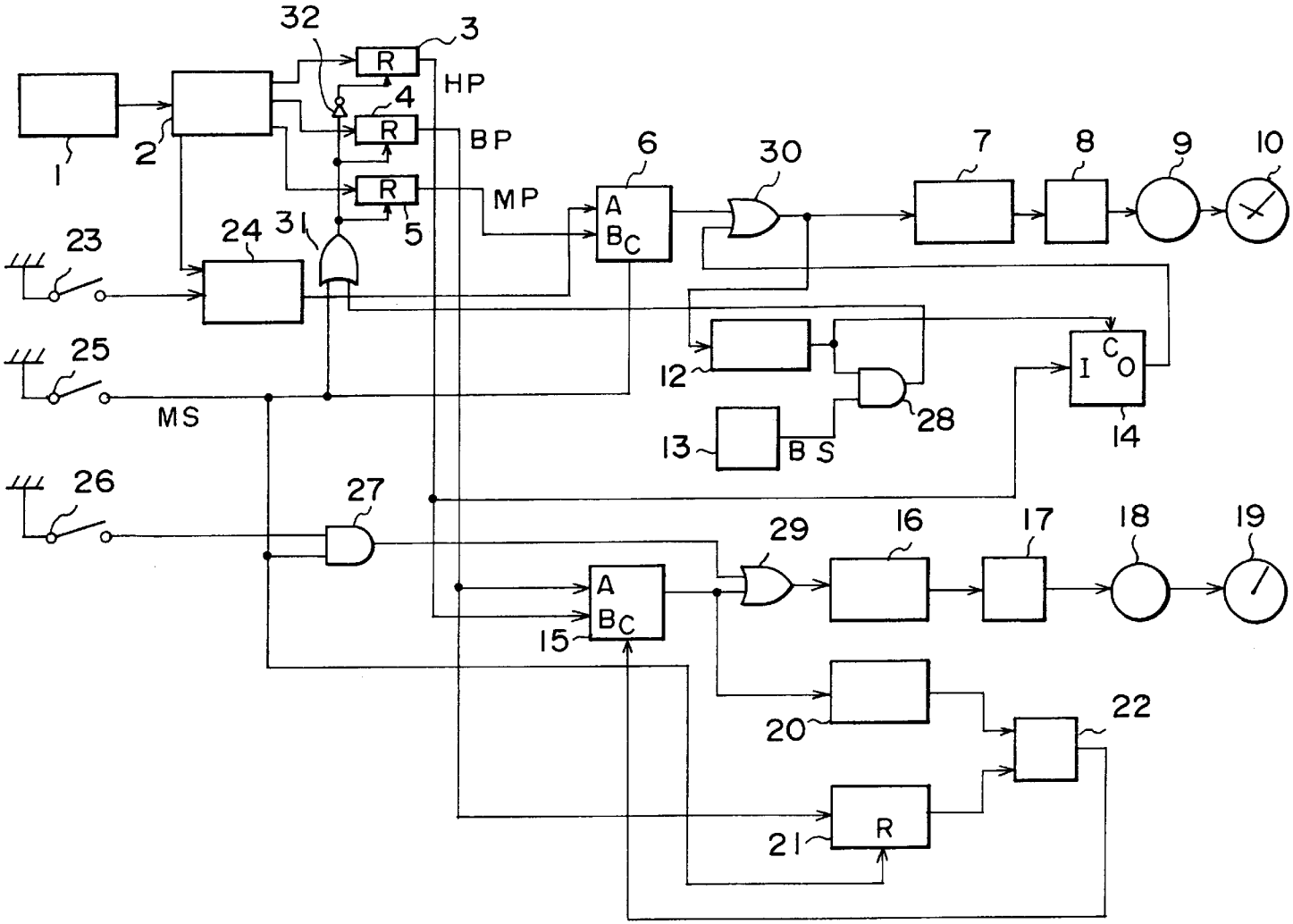
FIG. 1 is a block diagram showing an embodiment of a pointer-type electronic clock according to the present invention.

FIG. 1 is a block diagram showing an embodiment of a pointer-type electronic clock according to the present invention.

In FIG. 1, reference numeral 1 denotes an oscillating circuit. Reference numeral 2 denotes a dividing circuit. Reference numeral 3 denotes fast forward pulse generating means for generating a fast forward pulse HP for a correction. Reference numeral 4 denotes second pulse generating means for generating a second pulse BP. Reference numeral 5 denotes 20-second pulse generating means for generating a 20-second pulse MP. Reference numeral 6 denotes a selector A which outputs an A input when a C terminal is at "H" level and a B input when the C terminal is at "L" level, respectively. Reference numeral 7 denotes a waveform shaping circuit A which generates a pulse for driving an hour/minute hand. Reference numeral 8 denotes an hour/minute hand driving circuit. Reference numeral 9 denotes an hour/minute motor. Reference numeral 10 denotes an hour/minute hand.

Reference numeral 12 denotes a ternary counter which counts the 20-second pulse MP. When a count number is 0, a signal is output at "H" level. When the count number is 2, if the pulse is input again, the ternary counter 12 returns to 0. Reference numeral 13 denotes voltage detecting means. The voltage detecting means 13 outputs a voltage reduction signal BS at "H" level when a source voltage is a predetermined value or less. Reference numeral 14 denotes an hour/minute hand adjusting circuit. Only when the ternary counter 12 outputs the signal at "L" level to the C terminal, the fast forward pulse HP is allowed to pass through the hour/minute hand adjusting circuit 14.

Reference numeral 15 denotes a selector B which selects and outputs either the second pulse BP or the fast forward pulse HP. Reference numeral 16 denotes a waveform shaping circuit B which generates a pulse for driving a second hand. Reference numeral 17 denotes a second hand driving circuit. Reference numeral 18 denotes a second motor. Reference numeral 19 denotes a second hand.

Reference numeral 20 denotes a second hand position counter which corresponds to a position of the second hand 19. Reference numeral 21 denotes a second counter which counts a second of time. Reference numeral 22 denotes coincidence detecting means for detecting a coincidence of these two counters.

Reference numeral 23 denotes an hour/minute correcting switch. The hour/minute correcting switch 23 is pulled down through a resistance (not shown). Normally, the switch 23 outputs the signal at "L" level. When the switch is operated, the switch 23 outputs the signal at "H" level. Reference numeral 24 denotes hour/minute correction pulse generating means which outputs three pulses by one operation of the hour/minute correcting switch 23. Reference numeral 25 denotes a mode switch. Reference numeral 26 denotes a second correcting switch. Both the switches 25 and 26 are pulled down through the resistance in the same manner as the hour/minute correcting switch 23 (not shown). Normally, the switches 25 and 26 output the signal at "L" level. The switches 25 and 26 output the signal at "H" level by the switch operation. When the mode switch 25 is off, the electronic clock displays a present time in a normal state. When the mode switch 25 is turned on, the clock goes into a correction state.

Reference numerals 27 and 28 denote AND circuits. Reference numerals 29 through 31 denote OR circuits. Reference numeral 32 denotes an inverting circuit.

Figure 2:
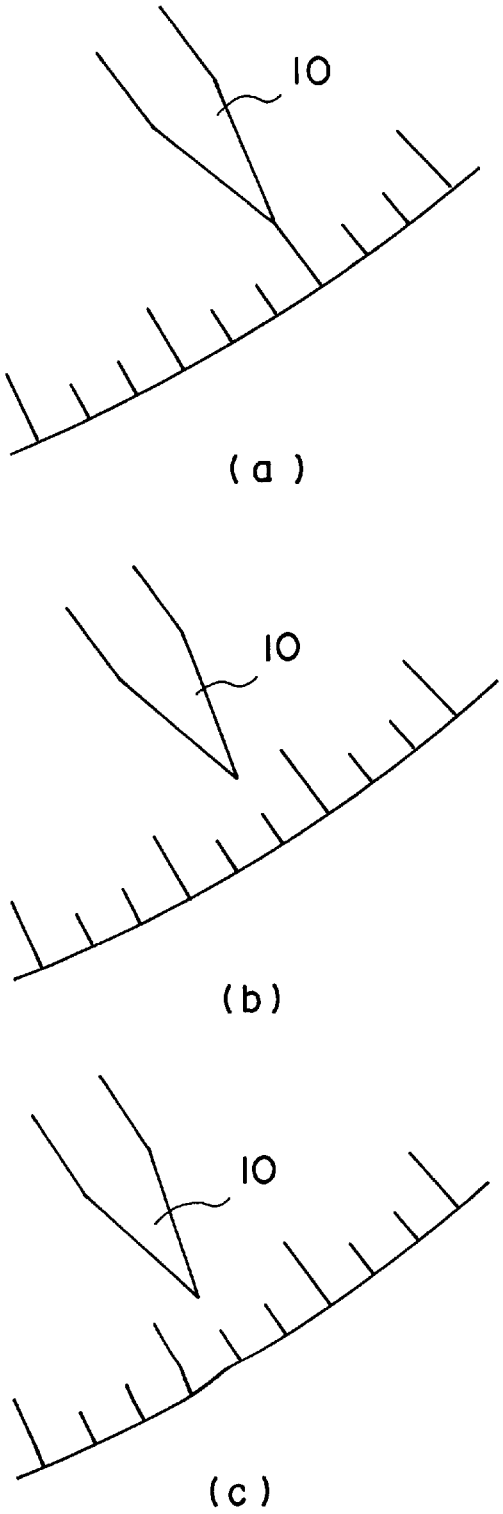
FIGS. 2*a*–2*c* are is a schematic illustration showing a pointer position of the pointer-type electronic clock according to the present invention.

Next, the operation of the pointer-type electronic clock of the present invention will be described with reference to FIGS. 1 and 2. FIG. 2 is a schematic illustration showing a positional relationship of the hour/minute hand 10 of the electronic clock according to the present invention.

In the first place, a simultaneous pressing of the switches 23, 25 and 26 or the like causes a clock circuit to be initialized. This operation does not relate directly to the present invention and is also a known technique. Thus, this operation is not shown and a detailed description is omitted.

Next, the mode switch 25 is turned on, whereby the clock is changed into the correction state. In this state, the second counter 21 is reset so as to thereby be 0. Immediately after an all reset, the second hand position counter 20 is also 0. Thus, the coincidence detecting circuit 22 detects the coincidence of both the counters 20 and 21 and then outputs the signal at "H" level to the selector B 15. However, since the second pulse generating means 4 is reset in the correction state, the second pulse BP is not output. Therefore, the second hand 19 remains stopped. The second hand position counter 20 also remains held at 0. When the second hand 19 is not stopped at the 0 position, the correcting switch 26 is operated so as to thereby allow the second hand 19 to take a step to the 0 position. Whenever the correcting switch 26 is pressed once, one pulse is output to the AND circuit 27. At this time, since the mode switch 25 is on, the AND circuit 27 outputs this pulse to the OR circuit 29. Accordingly, the second hand 19 alone is moved, and the second hand position counter 20 remains held at 0. In such a manner, the position of the second hand position counter 20 coincides with that of the second hand 19.

Moreover, when the ternary counter 12 is 0, a presetting of the minute hand 10 is required so that the minute hand 10 may be located at an exact minute position. For this purpose, the following operation is carried out. That is, a 0 position matching mode is provided. The switch operation causes the minute hand to gain ⅓ minute each. The ternary counter 12 remains at 0, while the minute hand is allowed to match the exact minute position. However, this operation does not relate directly to the present invention. Since the drawing is complicated if this operation is shown, this operation is omitted.

When the hour/minute correcting switch 23 is operated, three pulses are output from the hour/minute correction pulse generating means 24. The hour/minute hand 10 of the electronic clock of this embodiment gains ⅓ minute per pulse. Therefore, the three pulses allow the hour/minute hand 10 to gain just one minute. In the selector A, since a mode signal MS is at "H" level, these three correcting signals are output to the OR circuit 30. Since the ternary counter 12 has been just reset, its count value is 0. The signal is output at "H" level. Thus, the hour/minute hand adjusting circuit 14 does not output the fast forward pulse HP. The OR circuit 30 outputs the three pulses to the waveform shaping circuit 7. As a result, the hour/minute hand 10 takes a one-minute step. This operation is repeated, whereby the hour/minute hand 10 is set to the present time. The mode switch 25 is then turned off, whereby the second pulse generating means 4, the 20-second pulse generating means 5 and the second counter 21 are released from the reset. The second pulse BP is therefore output. The selector B thus outputs the second pulse BP to the OR circuit 29. Since the other input of the OR circuit 29 is at "L" level, the second pulse BP is output to the second hand position counter 20 and the waveform shaping circuit B 16. The second hand 19 starts a one-second movement. Since the second pulse BP is also input to the second counter 21, the second counter 21 is counted up together with the second hand position counter 20.

The 20-second pulse generating means 5 is also released from the reset and then outputs the 20-second pulse MP. At this time, since both of the mode signal MS and the voltage reduction signal BS are at "L" level, the output from the OR circuit 31 is at "L" level. The 20-second pulse MP is output to the OR circuit 30. Furthermore, since the fast forward pulse HP is not output, the 20-second pulse MP is output to the waveform shaping circuit A 7. The hour/minute hand 10 is thus caused to take a ⅓ step. In this way, the electronic clock is changed into a normal movement state. At this time, since the 20-second pulse MP is also input to the ternary counter 12, this is interlocked with the hour/minute hand 10 whereby the ternary counter 12 is counted up. That is, when the count value of the ternary counter is 0, the hour/minute hand 10 is at the exact minute position, namely, a position shown in FIG. 2(*a*). When the count value is 1, the hour/minute hand 10 is at a ⅓ step position, that is, a position shown in FIG. 2(*b*). When the count value is 2, the hour/minute hand 10 is at a ⅔ step position, that is, a position shown in FIG. 2(*c*).

When the electronic clock displays the present time in the normal state, if the mode switch 25 is turned on, the electronic clock is changed into the correction state. In the correction state, the fast forward pulse generating means 3 is released from the reset and thus outputs the fast forward pulse HP. The second pulse generating means 4 and the 20-second pulse generating means 5 are reset, whereby the pulses BP and MP are not output. Since the second counter 21 is also reset and thus is set to 0, the coincidence detecting circuit 22 detects a non-coincidence of the second hand position counter 20 and the second counter 21. The signal is then output at "L" level. Therefore, the selector B 15 outputs the fast forward pulse HP to the OR circuit 29. The OR circuit 29 outputs this fast forward pulse HP to the waveform shaping circuit B 16 and the second hand position counter 20. As a result, the second hand 19 is stopped at the 0 position.

When the ternary counter 12 is 1 or 2, the fast forward pulse HP is allowed to pass through the hour/minute hand adjusting circuit 14. The fast forward pulse HP is then output to the OR circuit 30. Thus, the hour/minute hand 10 takes a step, and the ternary counter 12 is counted up. When the ternary counter 12 reaches 0, the signal is output at "H" level. Thus, the hour/minute hand adjusting circuit 14 does not output the fast forward pulse HP. Accordingly, the hour/minute hand 10 is stopped at the exact minute position. The ternary counter 12 is stopped at 0.

When the hour/minute correcting switch 23 is operated in this state, three correcting pulses are output. The hour/minute hand 10 remains in the exact minute position, while it is corrected.

When the source voltage is reduced to a predetermined voltage or less in the normal movement state, the voltage detecting means 13 outputs the voltage reduction signal BS at "H" level. When the count value is 0, that is, when the hour/minute hand 10 reaches the exact minute position, the ternary counter 12 also outputs the signal at "H" level. Therefore, the AND circuit 28 outputs the signal at "H" level. The 20-second pulse generating means 5 and the second pulse generating means 4 are thus reset through the OR circuit 31. Accordingly, since the 20-second pulse MP is not output, the hour/minute hand 10 is stopped at the exact minute position. At this time, the reset of the second counter 21 also allows the second hand 19 to be stopped at the 0 position by means of the same operation as in the above-described correction state (not shown).

In this embodiment, even if the voltage detecting means 13 outputs the voltage reduction signal BS, until the ternary counter 12 reaches 0, the 20-second pulse generating means 5 is not reset. Therefore, even if a battery voltage is reduced, the clock continues to be operated for 59 seconds at maximum. This has no problem if the voltage to be detected by the voltage detecting means 13 is highly set to some extent. When the voltage reduction signal BS is input to the selector A 6, the selector B 15 and the OR circuit 31, the minute hand 10 is stopped at the exact minute position immediately after the reduction of the voltage. The clock can be thus set to a stop state.

Although the description is omitted, there is provided a switch which is operated at the time of removing a battery. The input of the switch may accomplish a control in such a manner that the above-mentioned operation is performed.

In this embodiment, although the ternary counter 12 is defined as an up counter, needless to say, the present invention can be also implemented by the use of an up-down counter. In this case, a reverse driving pulse generating circuit is provided. When the count value is 1, the ternary counter 12 may be counted down so as to thereby output one reverse pulse. When the count value is 2, the ternary counter may be counted up so as to thereby output one forward pulse. An hour/minute hand position counter for storing the position of the hour/minute hand is also provided, whereby the control can be operated by its count value.

Although this embodiment is arranged so that the hour/minute hand 10 may be moved at one step at 20-second intervals, the present invention is not limited to this example. The present invention also includes, for example, a 15-second-interval movement, a 10-second-interval movement or a 30-second-interval movement.

Although this embodiment has the voltage detecting means 13, the present invention is not limited to this example.

Figure 3:
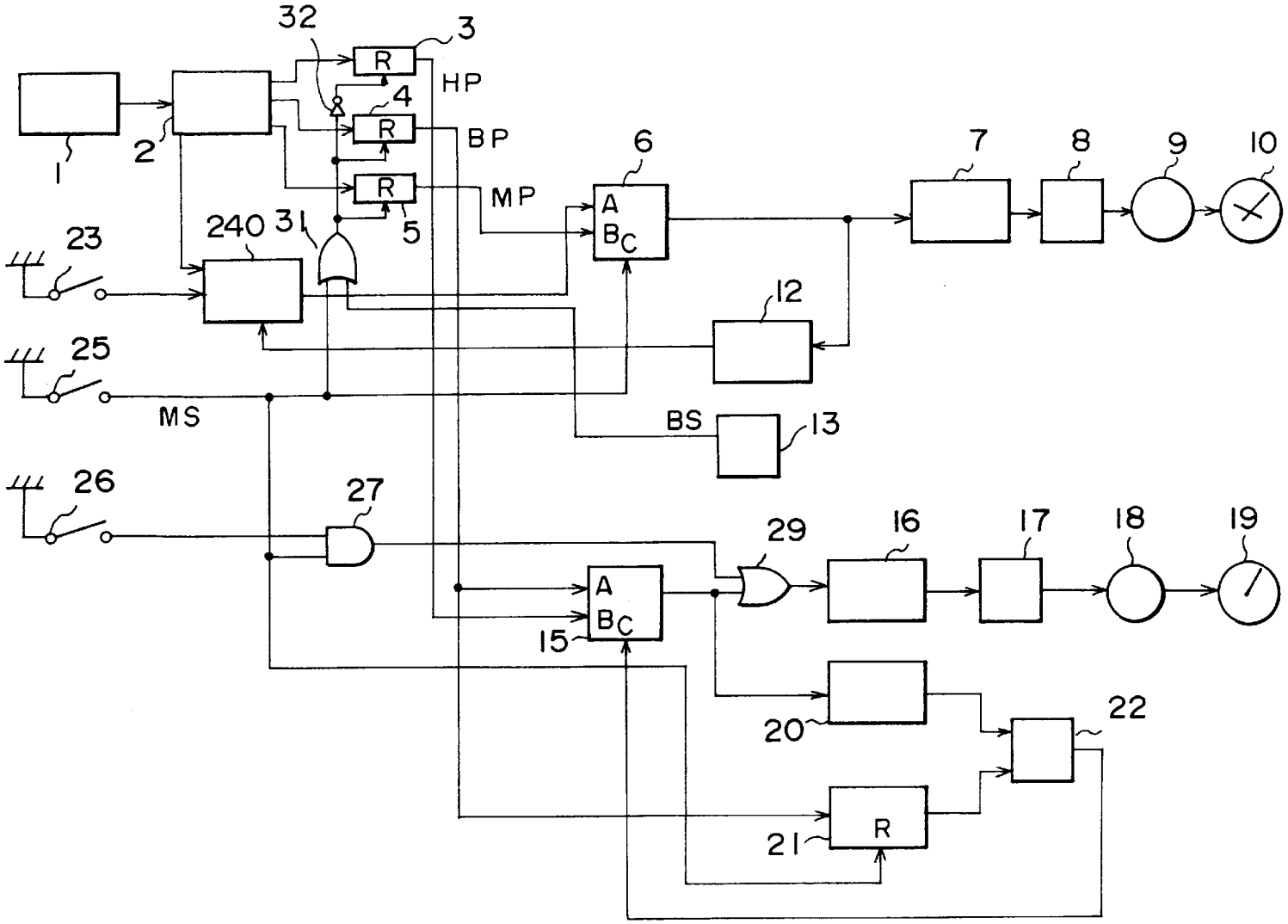
FIG. 3 is a block diagram showing another embodiment of the pointer type electronic clock according to the present invention.

FIG. 3 is a block diagram showing another embodiment of the pointer-type electronic clock according to the present invention. The same portions in FIG. 1 have the same reference numerals, and thus the description is omitted.

In FIG. 3, hour/minute correction pulse generating means 240 receives the pulse from the dividing circuit 2 and then generates an hour/minute hand correction pulse. At this time, in the same manner as the embodiment shown in FIG. 1, the input of the hour/minute correcting switch 23 allows three pulses to be generated. Furthermore, in this embodiment, the hour/minute correction pulse generating means 240 is arranged so that it may receive the value of the ternary counter 12 and may output a difference between these pulses and the count value.

The illustrative operation of this embodiment is as follows.

Since the operation is the same as in the embodiment shown in FIG. 1 in the normal state, the description is omitted.

When the mode switch 25 is turned on, the 20-second pulse generating means 5 is reset so as to thereby stop the output of the 20-second pulse MP. Thus, the hour/minute hand 10 is stopped at the position where the operation is performed. When the hour/minute correcting switch 23 is operated, the hour/minute correction pulse generating means 240 outputs as many correction pulses as the number of pulses resulting from the subtraction of the count value of the ternary counter 12 from 3. Accordingly, when the hour/minute hand 10 is stopped at the position located in 1-advance of the exact minute position, that is, (3−1), that is, 2 correction pulses are output. Therefore, the hour/minute hand 10 is stopped at the exact minute position. At this time, since the ternary counter 12 reaches 0, when the correcting switch 23 is then operated, the hour/minute hand 10 gains 3-step by 3-step. Thus, even if the hour/minute hand 10 is stopped anywhere, the first operation of the correcting switch 23 always allows the hour/minute hand 10 to be stopped at the exact minute position. After then, the correction can be performed minute by minute.

When the source voltage is reduced in the normal state, the 20-second pulse generating means 5 is reset by the voltage reduction signal BS output from the voltage detecting means 13. The following operation is described above.

POSSIBILITY OF INDUSTRIAL UTILIZATION

Although the present invention discloses a pointer-type electronic clock, the present invention can be applied to other devices indicating a any physical state by a pointer.

We claim:

1. A pointer-type electronic clock comprising:

a minute hand adapted to move at a plurality of divisional steps per minute in a time display state and at one step per minute in a time correction state;

a voltage detection circuit for outputting a voltage reduction signal when voltage of a power source for the clock decreases below a predetermined level; and minute hand position adjusting means for allowing the minute hand to stop after being moved onto any one of each minute scale.

2. The pointer-type electronic clock according to claim 1, wherein the minute hand is moved at n-time divisional steps per minute in the time display state, and the minute hand position adjusting means has an n-ary counter associated with a position of the minute hand.

3. The pointer-type electronic clock according to claim 2, wherein the minute hand position adjusting means is adapted to stop the minute hand on the basis of the voltage reduction signal and the output of the n-ary counter.

4. A pointer-type electronic clock comprising:

a minute hand adapted to move at a plurality of divisional steps per minute in a time display state and at one step per minute in a time correction state;

a voltage detection circuit for outputting a voltage reduction signal when voltage of a power source for the clock decreases below a predetermined level; and minute hand position adjusting means for allowing the minute hand to move onto any one of each minute scale in response to time correction operation in the time correction state after the minute hand is stopped in response to the voltage reduction signal.

5. The pointer-type electronic clock according to claim 4, wherein the minute hand is moved at n-time divisional steps per minute in the time display state, and the minute hand position adjusting means has an n-ary counter associated with a position of the minute hand.

6. The pointer-type electronic clock according to claim 5, wherein the minute hand position adjusting means is adapted to stop the minute hand on the basis of the voltage reduction signal and the output of the n-ary counter.

* * * * *